US008271291B2

(12) United States Patent
Chon et al.

(10) Patent No.: US 8,271,291 B2
(45) Date of Patent: Sep. 18, 2012

(54) METHOD AND AN APPARATUS FOR IDENTIFYING FRAME TYPE

(75) Inventors: Sang Bae Chon, Seoul (KR); Lae Hoon Kim, Seoul (KR); Koeng Mo Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 638 days.

(21) Appl. No.: 12/463,141

(22) Filed: May 8, 2009

(65) Prior Publication Data

US 2009/0306994 A1 Dec. 10, 2009

Related U.S. Application Data

(63) Continuation of application No. PCT/KR2009/000137, filed on Jan. 9, 2009.

(60) Provisional application No. 61/019,844, filed on Jan. 9, 2008.

(51) Int. Cl.
*G10L 19/00* (2006.01)

(52) U.S. Cl. ..... 704/500; 714/752; 709/227; 704/262; 704/241; 704/216; 704/210; 704/208; 700/94; 386/205; 375/240.12; 375/240.07

(58) Field of Classification Search ..... 704/208, 704/216, 500, 262, 241, 210; 714/752; 709/227; 700/94; 386/205; 375/240.12, 240.07
See application file for complete search history.

(56) References Cited

U.S. PATENT DOCUMENTS 6,085,163 A * 7/2000 Todd ..... 704/500
6,405,338 B1 * 6/2002 Sinha et al. ..... 714/752
6,408,267 B1 * 6/2002 Proust ..... 704/210
6,658,381 B1 * 12/2003 Hellwig et al. ..... 704/216
6,757,654 B1 * 6/2004 Westerlund et al. ..... 704/262
6,810,377 B1 * 10/2004 Ho et al. ..... 704/208
6,934,756 B2 * 8/2005 Maes ..... 709/227
6,978,236 B1 12/2005 Liljeryd et al.
7,024,358 B2 * 4/2006 Shlomot et al. ..... 704/241

(Continued)

FOREIGN PATENT DOCUMENTS

WO WO 99/53479 A1 10/1999

(Continued)

OTHER PUBLICATIONS

ISO/IEC 14496-3: 2005(E), "Information Technology—Coding of Audio-Visual Objects—Part 3: Audio," Third Edition, Dec. 2005, 400 pages.

(Continued)

*Primary Examiner* — Michael Colucci
(74) *Attorney, Agent, or Firm* — Birch, Stewart, Kolasch & Birch, LLP

(57) ABSTRACT

A method for identifying a frame type is disclosed. The present invention includes receiving current frame type information, obtaining previously received previous frame type information, generating frame identification information of a current frame using the current frame type information and the previous frame type information, and identifying the current frame using the frame identification information.
And, a method for identifying a frame type is disclosed. The present invention includes receiving a backward type bit corresponding to current frame type information, obtaining a forward type bit corresponding to previous frame type information, generating frame identification information of a current frame by placing the backward type bit at a first position and placing the forward type bit at a second position.

12 Claims, 11 Drawing Sheets

U.S. PATENT DOCUMENTS

| | | | | |
|---|---|---|---|---|
| 7,075,985 | B2 * | 7/2006 | Lee | 375/240.12 |
| 7,451,091 | B2 | 11/2008 | Chong et al. | |
| 8,041,578 | B2 | 10/2011 | Schnell et al. | |
| 2002/0126988 | A1 * | 9/2002 | Togashi et al. | 386/68 |
| 2003/0031252 | A1 * | 2/2003 | Miyazawa | 375/240.07 |
| 2004/0165560 | A1 | 8/2004 | Harris et al. | |
| 2008/0077411 | A1 | 3/2008 | Takeya et al. | |
| 2008/0228472 | A1 | 9/2008 | Park et al. | |
| 2008/0234846 | A1 * | 9/2008 | Malvar | 700/94 |
| 2010/0312567 | A1 | 12/2010 | Oh et al. | |

FOREIGN PATENT DOCUMENTS

| | | | |
|---|---|---|---|
| WO | WO 01/29999 | A1 | 4/2001 |
| WO | WO 2006/083550 | A2 | 8/2006 |

OTHER PUBLICATIONS

Meltzer et al., "MPEG-4, HE-AAC v2—Audio Coding for Today's Digital Media World," EBU Technical Review, Jan. 2006, pp. 1-12.

Ryu et al., "Frame Loss Concealment for Audio Decoders Employing Spectral Band Replication," Audio Engineering Society, Convention Paper 6962, Presented at the 121st Convention, San Francisco, CA, USA, Oct. 5-8, 2006, pp. 1-13.

* cited by examiner (A)

(B)

METHOD AND AN APPARATUS FOR IDENTIFYING FRAME TYPE

This application is a Continuation of copending PCT International Application No. PCT/KR2009/00137 filed on Jan. 9, 2009, which designated the United States, and on which priority is claimed under 35 U.S.C. §120. This application also claims priority under 35 U.S.C. §119(e) on U.S. Provisional Application No. 61/019,844 filed in United States of America on Jan. 9, 2008. The entire contents of each is hereby incorporated by reference into the present application.

BACKGROUND OF THE INVENTION

1. Field of the Invention

The present invention relates to an apparatus for processing a signal and method thereof. Although the present invention is suitable for a wide scope of applications, it is particularly suitable for encoding/decoding band extension information of an audio signal.

2. Discussion of the Related Art

Generally, information for decoding an audio signal is transmitted by a frame unit and information belonging to each frame is repeatedly transmitted according to a predetermined rule. Although information is separately transmitted per frame, there may exist correlation between information of a previous frame and information of a current frame like frame type information.

However, in the related art, when correlation exists between information of a previous frame and information of a current frame, if information on each frame is transmitted per frame irrespective of the correlation, the number of bits is unnecessarily incremented.

SUMMARY OF THE INVENTION

Accordingly, the present invention is directed to an apparatus for processing a signal and method thereof that substantially obviate one or more of the problems due to limitations and disadvantages of the related art.

An object of the present invention is to provide an apparatus for processing a signal and method thereof, by which information of a current frame is encoded/decoded based on correlation between information of a previous frame and information of a current frame.

Another object of the present invention is to provide an apparatus for processing a signal and method thereof, by which frame identification information corresponding to a current frame is generated using transferred type information of a current frame and type information of a previous frame.

A further object of the present invention is to provide an apparatus for processing a signal and method thereof, by which a high frequency band signal is generated based on band extension information including frame type information.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method for identifying a frame type according to the present invention includes receiving current frame type information, obtaining previously received previous frame type information, generating frame identification information of a current frame using the current frame type information and the previous frame type information, and identifying the current frame using the frame identification information.

According to the present invention, the frame identification information includes forward type information and backward type information, the forward type information is determined according to the previous frame type information, and the backward type information is determined according to the current frame type information.

According to the present invention, at least one of the previous frame type information and the current frame type information corresponds a fixed type or a variable type.

According to the present invention, the method further includes if the previous frame type information is a variable type, determining a start position of a block and if the current frame type information is a variable type, determining an end position of the block.

According to the present invention, if both of the current frame type information and the previous frame type information are fixed types, the number of blocks corresponding to the current frame is $2^n$ (wherein n is an integer).

According to the present invention, the blocks are equal to each other in size.

To further achieve these and other advantages and in accordance with the purpose of the present invention, an apparatus for identifying a frame type includes an information extracting unit receiving current frame type information, the information extracting unit obtaining previously received previous frame type information, a frame identification information generating unit generating frame identification information of a current frame using the current frame type information and the previous frame type information, and a frame identifying unit identifying the current frame using the frame identification information.

To further achieve these and other advantages and in accordance with the purpose of the present invention, a method for identifying a frame type includes determining frame identification information of a current frame, the frame identification information including a forward type and a backward type and generating current frame type information based on the backward type included in the frame identification information, wherein the forward type is determined by frame identification information of a previous frame.

To further achieve these and other advantages and in accordance with the purpose of the present invention, an apparatus for identifying a frame type includes a frame identification information determining unit determining frame identification information of a current frame, the frame identification information including a forward type and a backward type and a type information generating unit generating current frame type information based on the backward type included in the frame identification information, wherein the forward type is determined by frame identification information of a previous frame.

To further achieve these and other advantages and in accordance with the purpose of the present invention, a computer-readable storage medium includes digital audio data stored therein, wherein the digital audio data includes previous type frame information corresponding to a previous frame type and current frame information corresponding to a current frame, wherein the current frame information includes current frame type information, and wherein if frame identification information includes a forward type and a backward type, the current frame type information is determined by the backward type.

To further achieve these and other advantages and in accordance with the purpose of the present invention, a method for identifying a frame type includes receiving a backward type bit corresponding to current frame type information, obtaining a forward type bit corresponding to previous frame type information, generating frame identification information of a current frame by placing the backward type bit at a first position and placing the forward type bit at a second position.

According to the present invention, the first position is a last position and the second position is a previous position of the last position.

According to the present invention, at least one of the forward type bit and the backward type bit indicates whether to correspond to one of a fixed type and a variable type.

According to the present invention, each of the forward type bit and the backward type bit corresponds to one bit and the frame identification information corresponds to two bits.

To further achieve these and other advantages and in accordance with the purpose of the present invention, an apparatus for identifying a frame type includes an information extracting unit receiving a backward type bit corresponding to current frame type information, the information extracting unit obtaining a forward type bit corresponding to previous frame type information and a frame identification information generating unit generating frame identification information of a current frame by placing the backward type bit at a first position and placing the forward type bit at a second position.

To further achieve these and other advantages and in accordance with the purpose of the present invention, a method for identifying a frame type includes determining frame identification information of a current frame, the frame identification information including a forward type bit and a backward type bit and generating current frame type information based on the backward type bit included in the frame identification information, wherein the forward type bit is determined by frame identification information of a previous frame.

To further achieve these and other advantages and in accordance with the purpose of the present invention, an apparatus for identifying a frame type includes a frame identification information determining unit determining frame identification information of a current frame, the frame identification information including a forward type bit and a backward type bit, and a frame type information generating unit generating current frame type information based on the backward type bit included in the frame identification information, wherein the forward type bit is determined by frame identification information of a previous frame.

To further achieve these and other advantages and in accordance with the purpose of the present invention, a computer-readable storage medium includes digital audio data stored therein, wherein the digital audio data includes previous frame information corresponding to a previous frame and current frame information corresponding to a current frame, wherein the current frame information includes current frame type information, and wherein if frame identification information includes a forward type bit and a backward type bit, the current frame type information is determined by the backward type bit.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

First of all, terminologies in the present invention can be construed as the following references. Terminologies not disclosed in this specification can be construed as the following meanings and concepts matching the technical idea of the present invention. Therefore, the configuration implemented in the embodiment and drawings of this disclosure is just one most preferred embodiment of the present invention and fails to represent all technical ideas of the present invention. Thus, it is understood that various modifications/variations and equivalents can exist to replace them at the timing point of filing this application.

In the present invention, the following terminologies can be construed as the following references and an undisclosed terminology can be construed as the following intent. It is understood that 'coding' can be construed as encoding or coding in a specific case. 'Information' is the terminology that generally includes values, parameters, coefficients, elements and the like and its meaning can be construed as different occasionally, by which the present invention is non-limited.

In this disclosure, an audio signal is conceptionally discriminated from a video signal in a broad sense and can be interpreted as a signal identified auditorily in reproduction. The audio signal is conceptionally discriminated from a speech signal in a narrow sense and can be interpreted as a signal having none of a speech characteristic or a small speech characteristic. In the present invention, an audio signal should be construed in a broad sense. The audio signal can be understood as an audio signal in a narrow sense in case of being used as discriminated from a speech signal.

Meanwhile, a frame indicates a unit for encoding/decoding an audio signal and is not limited to a specific sample number or a specific time.

An audio signal processing method and apparatus according to the present invention can become a frame information encoding/decoding apparatus and method and can further become an audio signal encoding/decoding method and apparatus having the former apparatus and method applied thereto. In the following description, a frame information encoding/decoding apparatus and method are explained and a frame information encoding/decoding method performed by the frame information encoding/decoding apparatus and an audio signal encoding/decoding method having the frame information encoding/decoding apparatus applied thereto are then explained.

1. Frame Type

Figure 1:
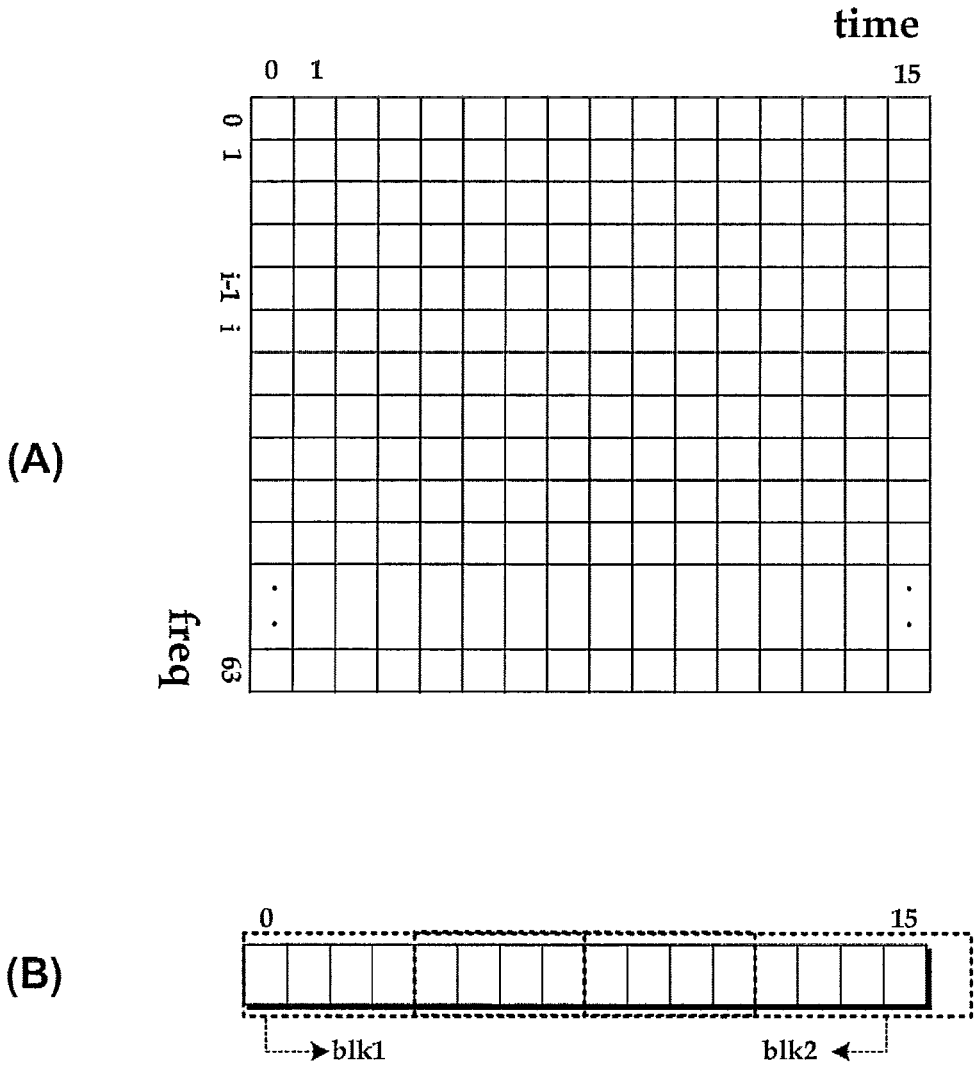
FIG. 1 is a diagram to explain the relation between a frame and a block.

FIG. 1 is a diagram to explain the relation between a frame and a block.

Referring to (A) of FIG. 1, as a result of performing a frequency analysis on one frame, it can be observed that information corresponding to total 64 bands on a vertical axis and total 16 timeslots on a horizontal axis. Meanwhile, one timeslot may correspond to two samples, by which the present invention is non-limited. Moreover, one frame can be grouped into at least one block according to a characteristic of a unit (e.g., timeslot). For instance, one frame can be divided into one to five blocks according to a presence or non-presence of a transient portion and a position thereof.

1.1 Relation Between Boundary Lines of Frame and Block

There can be a fixed type or a variable type according to whether a block boundary and a frame boundary meet. In the fixed type, a boundary of a block and a boundary of a frame meet each other like a first block blk1 shown in (B) of FIG. 1. In the variable type, a boundary of a block and a boundary of a frame fail to meet each other like a second block blk2 shown in (B) of FIG. 1.

1.2 Block Type

Meanwhile, a size of a block may be fixed or variable. In case of a fixed size, a block size is equally determined according to the number of blocks. In case of a variable size, a block size is determined using the number of blocks and block position information. Whether a block size is fixed or variable can be determined according to whether the frame boundaries meet, which is explained the above description. In particular, if both a start boundary ('forward' explained later) of a frame and an end boundary ('backward' explained later) of the frame are the fixed type, a block size may be fixed.

1.3 Frame Type

A frame type can be determined according to a start portion and an end portion of a frame. In particular, it is able to determine frame identification information according to whether a boundary line of a start portion of a frame is a fixed type or a variable type, or whether a boundary line of an end portion of a frame is a fixed type or a variable type. For instance, determination can be made n a manner of Table 1.

TABLE 1

| Identification information indicating frame type | Forward type | Backward type |
|---|---|---|
| Dependent | Fixed type | Fixed type |
| Forward dependent | Fixed type | Variable type |
| Backward dependent | Variable type | Fixed type |
| Independent | Variable type | Variable type |

Whether a boundary line of a start portion of a frame is a fixed type or a variable type corresponds to a forward type. And, whether a boundary line of an end portion of a frame is a fixed type or a variable type corresponds to a backward type. Referring to Table 1, if both a forward type and a backward type correspond to a fixed type, frame identification information is dependent. If both of them correspond to a variable type, frame identification information can become independent.

Figure 2:
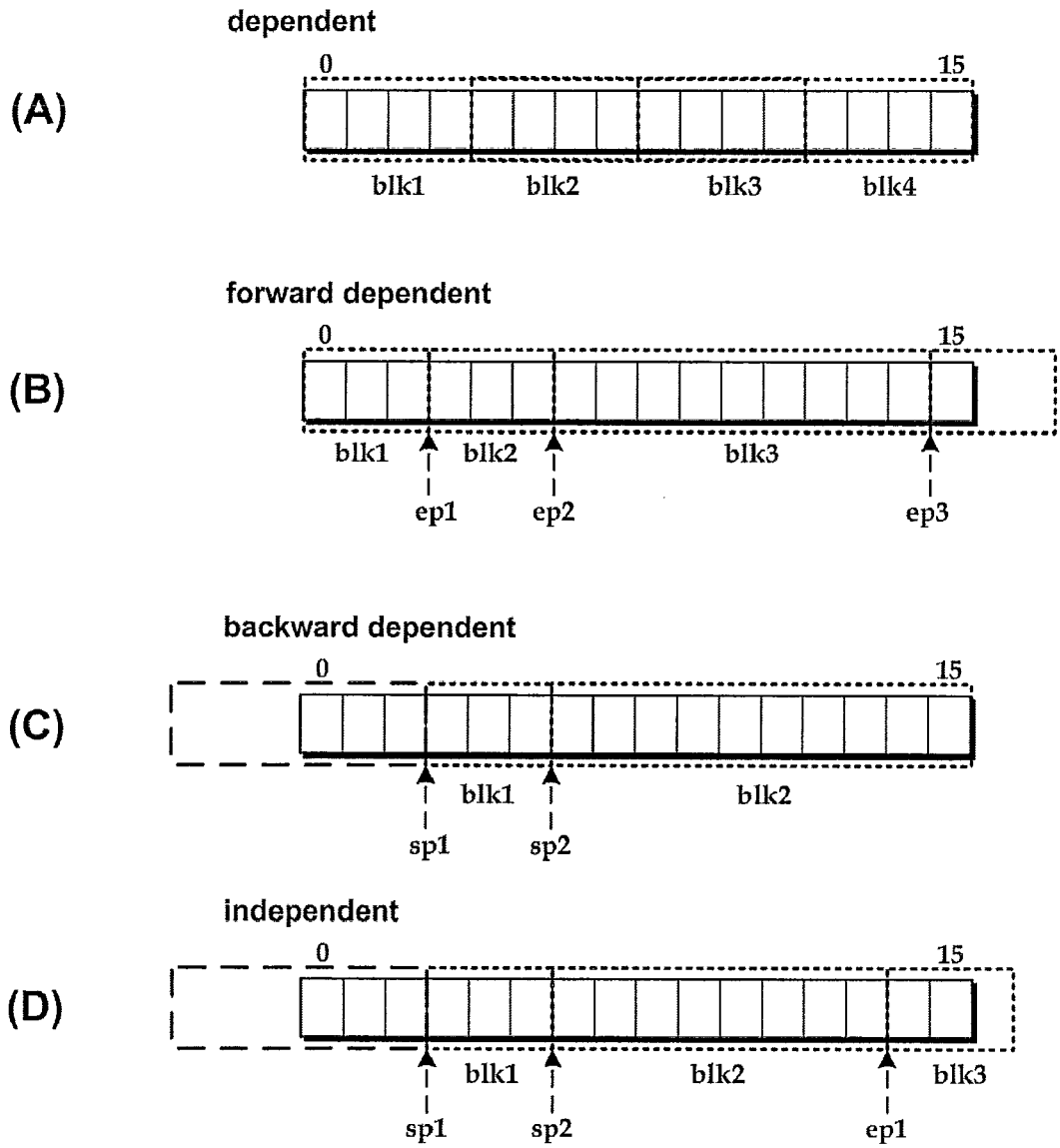
FIG. 2 is a diagram to explain a frame type.

FIG. 2 is a diagram to explain a frame type, in which examples of four frame types represented in Table 1 are shown in order.

Referring to (A) of FIG. 2, if a frame type is dependent, a transient section may not exist. In this case, one to 4 blocks can exist. And, it can be observed that lengths or sizes of the blocks are equal. Moreover, it can be also observed that a block section coincides with a frame section in a start or end portion. Hence, it is able to estimate a size and position of a corresponding block using information on the number of blocks.

Referring to (B) of FIG. 2, if a frame type is forward dependent, a transient section can exist next to a start position of a frame. One to five blocks can exist. In this case, unlike the case of the dependent, the blocks may not be equal in size. If so, a start position of a first block blk1 coincides with a start position of a frame. Yet, end positions of blocks (blk3, etc.) fail to coincide with an end position of a frame. Therefore, a decoder is unable to reconstruct a characteristic of a corresponding block unless end position information of each block is transmitted as well as information on the number of blocks.

Referring to (C) of FIG. 2, if a frame type is backward dependent, a transient section can exist behind an end position of a frame. The backward dependent differs from the forward dependent in that an end position of a last block blk2 coincides with an end position of a frame but a start position of a fist block blk1 fails to coincide with a start position of the frame. Therefore, start position information of each block should be transmitted.

Referring to (D) of FIG. 2, if a frame type is independent, transient sections can exist at the head and tail of a frame, respectively. In this case, start and end boundaries of a frame fail to coincide with a boundary of a frame. At least one of start position information and end position information on each lock should be transmitted.

1.4 Frame Type Identification

The bit number (i.e., the number of bits) of frame identification information for identifying a frame type is basically proportional to the number of case or kind for types. For instance, if there are four kinds of frame types, frame identification information can be represented as two bits. If there are five to eight kinds of frame types, frame identification information can be represented as three bits. As exemplarily shown in Table 1, since there are four kinds of frame types, two bits are needed to represent identification information.

Meanwhile, if correlation exists between a previous frame and a current frame like a frame type, it is able to reduce the bit number of frame identification information. In the following description, the correlation is explained with reference to FIG. 3 and a frame type identifying apparatus and a frame type identifying method performed by the apparatus will then be explained with references to FIGS. 4 to 7.

Figure 3:
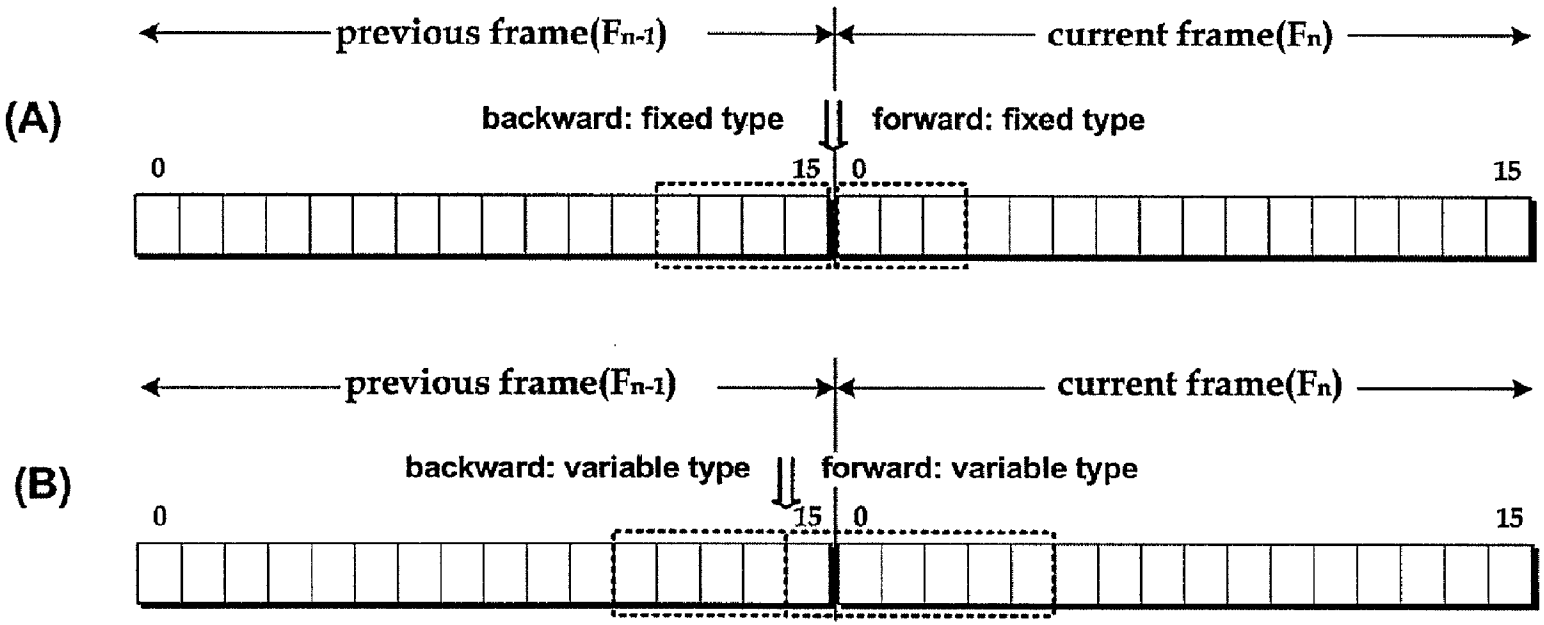
FIG. 3 is a diagram to explain correlation between a previous frame type and a current frame type.

FIG. 3 is a diagram to explain correlation between a previous frame type and a current frame type.

Referring to (A) of FIG. 3, it can be observed that a backward type of a frame type in a previous frame is a fixed type. Since the backward type is the fixed type, a rear boundary of a block coincides with a boundary of a frame. And, a block of a current frame connected to the previous frame starts from the boundary of the frame. Therefore, it can be observed that a forward type among current frame types becomes a fixed type.

Referring to (B) of FIG. 3, when a backward type of a previous frame is a variable type, a boundary of a block fails to coincide with a boundary of a frame. Therefore, since a next block does not start from the boundary of the frame, it can be observed that a forward type of a current frame becomes a variable type. Thus, it is understood that a forward type of current frame types is associated with a backward type of a previous frame.

In the following description, a frame type information generating apparatus and method for generating frame type information using frame identification information are explained with reference to FIG. 4 and FIG. 5 and a frame type identifying method and apparatus for generating frame identification information by receiving frame type information will be then explained with reference to FIG. 6 and FIG. 7.

Figure 4:
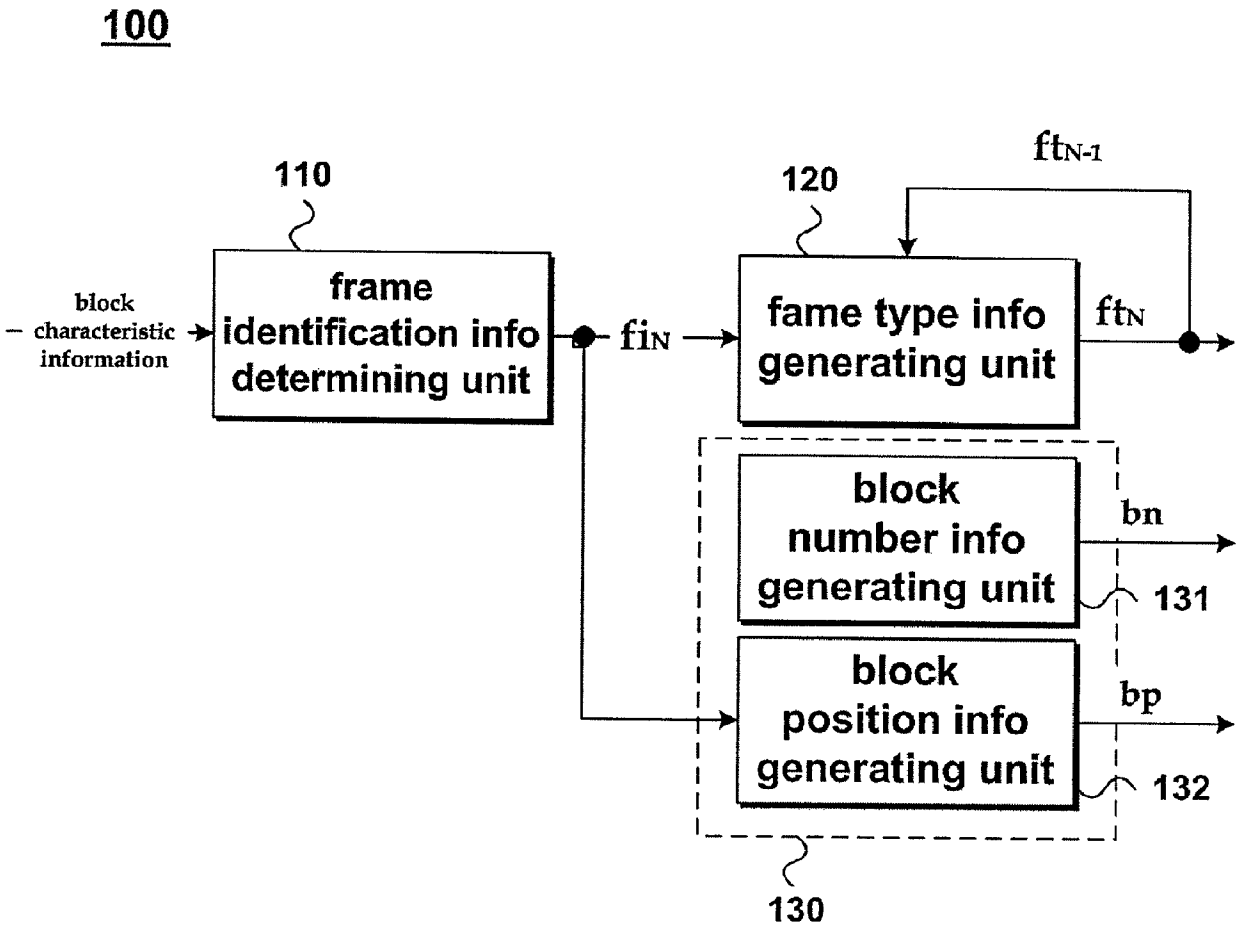
FIG. 4 is a block diagram of a frame type information generating apparatus according to an embodiment of the present invention.

FIG. 4 is a block diagram of a frame type information generating apparatus according to an embodiment of the present invention.

Referring to FIG. 4, a frame type information generating apparatus 100 includes a frame type information generating unit 120 and can further include a frame identification information determining unit 110 and a bock information generating unit 130. Moreover, the block information generating unit 130 can include a block number information generating unit 131 and a block position information generating unit 132.

The frame identification information determining unit 110 determines frame identification information $fi_N$ for indicating a frame type of a current frame based on block characteristic information. As mentioned in the foregoing description, the frame type can be determined according to the boundaries of the blocks meet and can include a forward type and a backward type. In particular, the frame type may be one of the four kinds shown in Table 1, by which the present invention is non-limited.

The frame type information generating unit 120 determines current frame type information $ft_N$ based on frame identification information $fi_N$. In particular, frame type information id determined by previous frame identification information $fi_{N-1}$ and current frame identification information $fi_N$.

Figure 5:
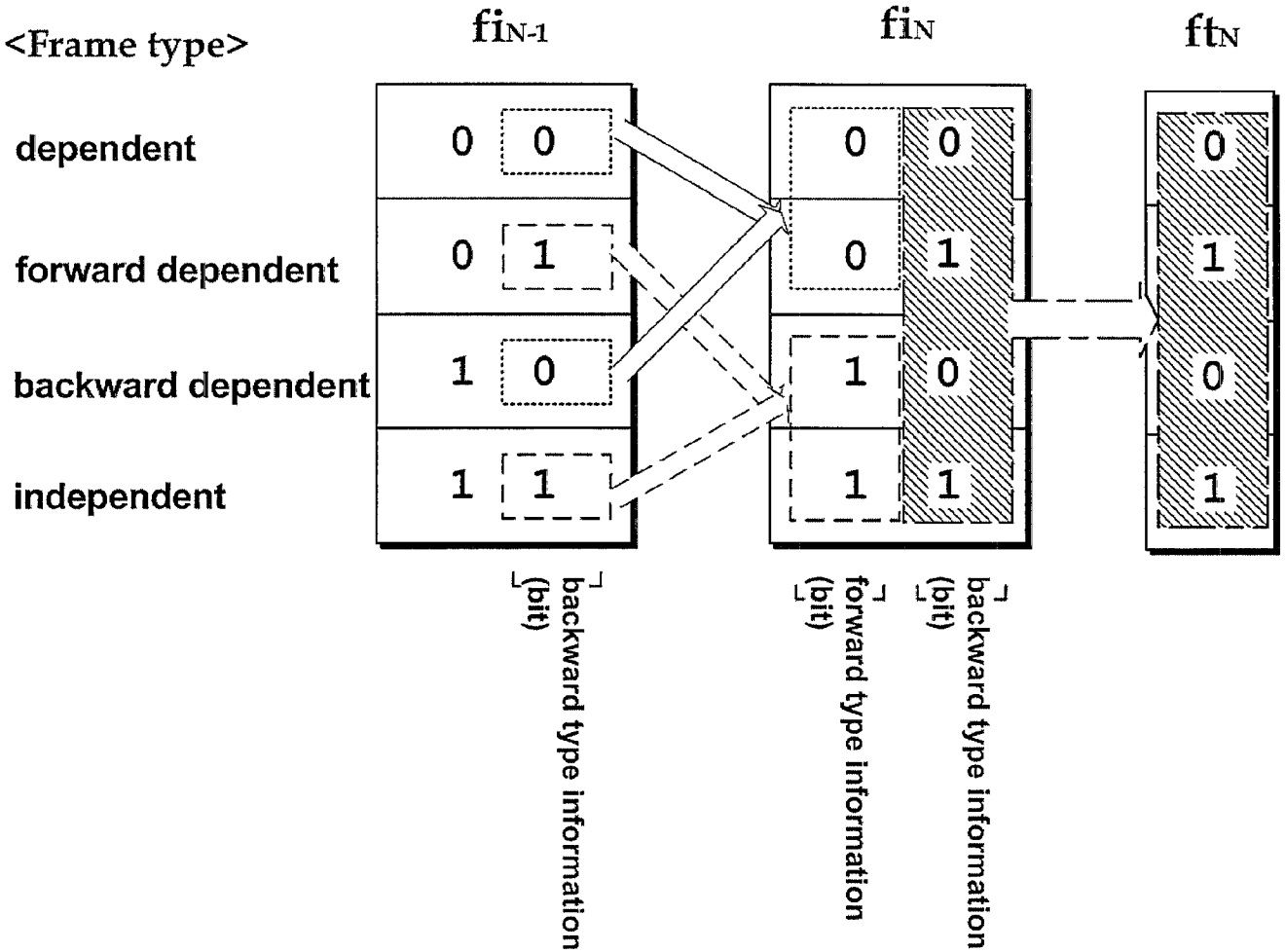
FIG. 5 is a diagram to explain a process for generating current frame type information.

FIG. 5 is a diagram to explain a process for generating current frame type information. Referring to FIG. 5, it can be observed that each of the previous frame identification information $fi_{N-1}$ and the current frame identification information $fi_N$ indicates one type of four types (dependent, forward dependent, backward dependent or independent). In this case, as mentioned in the foregoing description, a backward type among previous frame types and a forward type among current frame types are in association with each other. In other words, a forward type among the current frame types is determined by a backward type among the previous frame types. Therefore, current frame type information $ft_N$ is generated using backward type information except forward type information among current frame identification information $fi_N$.

The block information generating unit 130 generates at least one of block number information and block position information according to the current frame identification information $fi_N$. In particular, if a current frame type is the aforesaid dependent, it is able to generate the block number information only. In this case, a size of a block can become an equal value resulting from dividing a frame size by a block number [cf. (A) of FIG. 2].

If the current frame type is not dependent, it is able to further generate the block position information as well as the block number information. If the current frame type is forward dependent, it is able to generate end position information of a block among block position information [cf. ep1, ep2 and ep3 shown in (B) of FIG. 2]. If the current frame type is backward dependent, it is able to generate start position information of a block among block position information [cf. sp1 and sp2 shown in (C) of FIG. 2]. Finally, if the current frame type is independent, it is able to generate both of the start position information of the block and the end position information of the block [cf. sp1, sp2 and ep1 shown in (D) of FIG. 2].

In summary, the block number information generating unit 131 generates the number of blocks for all the current frame types. If the current frame type is not the dependent, the block position information generating unit 132 is able to generate at least one of the start position information of the block and the end position information of the block.

Thus, a frame identification information generating apparatus according to an embodiment of the present invention is able to encode information corresponding to a current frame based on the correlation between previous frame information and current frame information.

Figure 6:
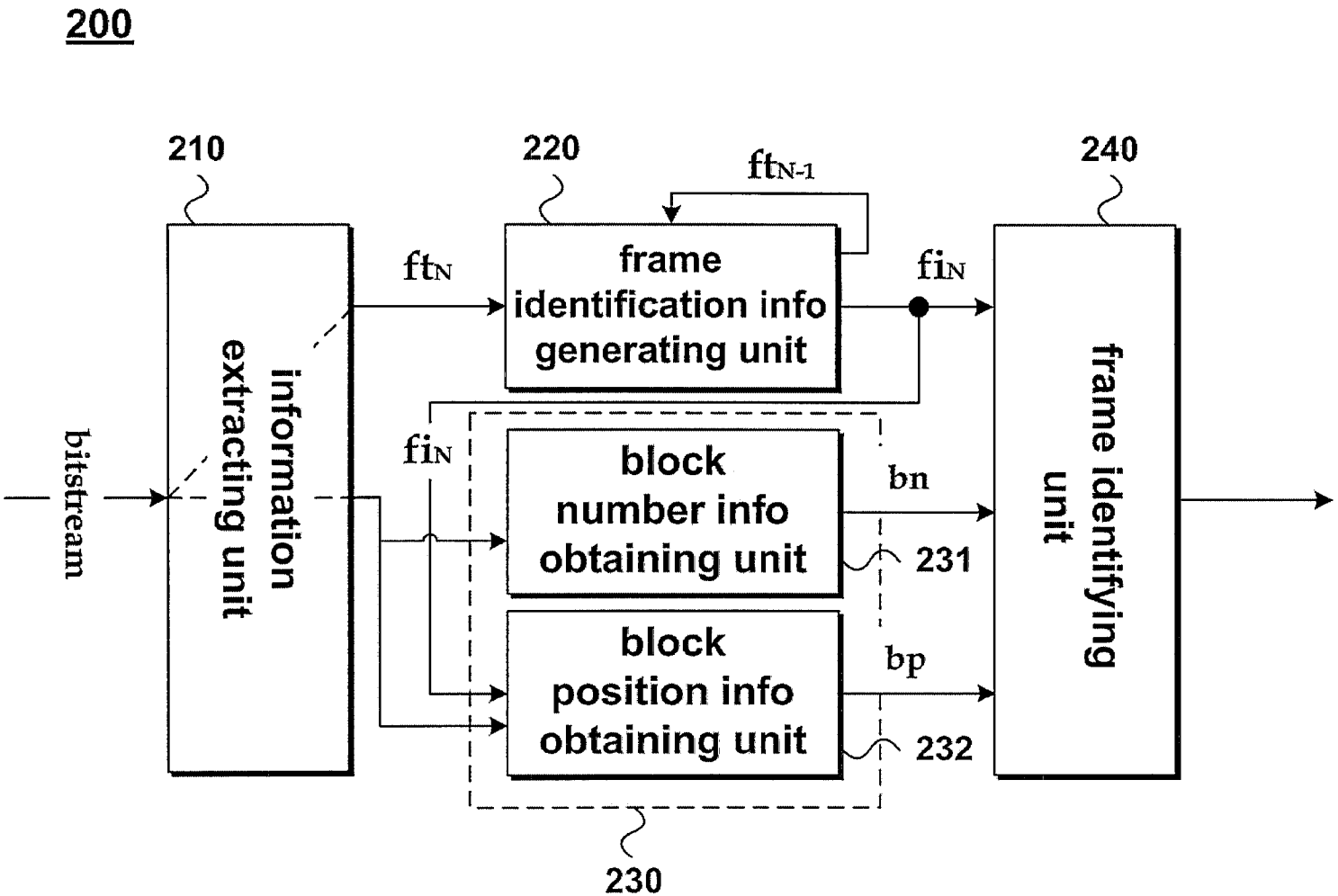
FIG. 6 is a block diagram of a frame type identifying apparatus according to an embodiment of the present invention.

FIG. 6 is a block diagram of a frame type identifying apparatus according to an embodiment of the present invention.

Referring to FIG. 6, a frame type identifying apparatus 200 includes a frame identification information generating unit 220 and can further include an information extracting unit 210, block information obtaining unit 230 and a frame identifying unit 240. Moreover, the block information obtaining unit 230 is able to include a block number information obtaining unit 231 and a block position information obtaining unit 232.

The information extracting unit 210 extracts current frame type information $ft_N$ from a bitstream and obtains previous frame type information $ft_{N-1}$ received in advance. The information extracting unit 210 then forwards the bitstream to the block number information obtaining unit 231 and the block position information obtaining unit 232.

And, the frame identification information generating unit 220 generates frame identification information of a current frame using current frame type information $ft_N$ and previous frame type information $ft_{N-1}$.

Figure 7:
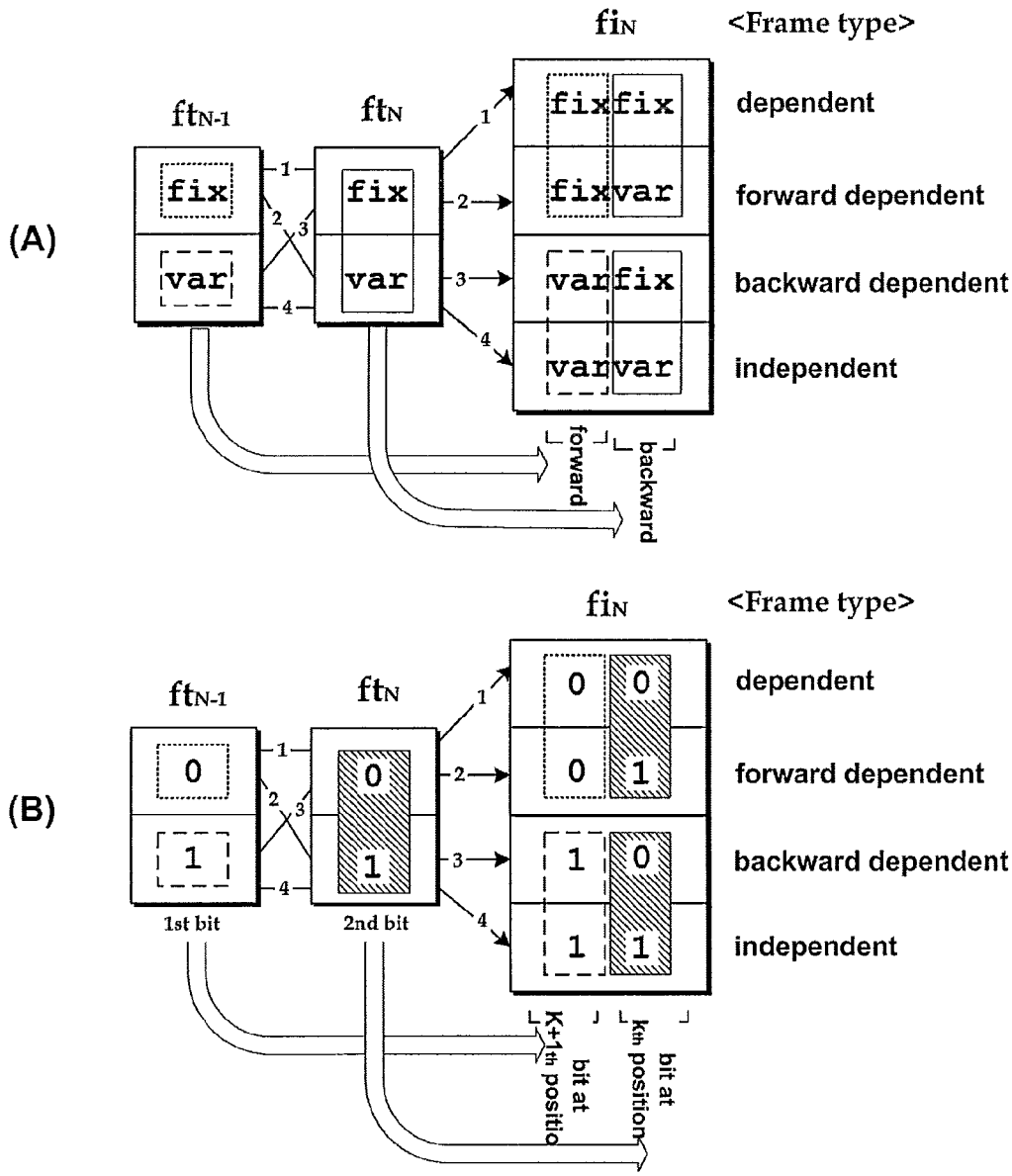
FIG. 7 is a diagram to explain a process for generating current frame identification information.

FIG. 7 is a diagram to explain a process for generating current frame identification information.

Referring to (A) of FIG. 7, it can be observed that forward type information of a current frame type $fi_N$ is determined by type information $ft_{N-1}$ of a previous frame. And, it can be also observed that backward type information of a current frame type $fi_N$ is determined by type information $ft_N$ of a current frame. Thus, current frame identification information is determined by forward type information and backward type information. And, a frame type can be determined as one of dependent, forward dependent, backward dependent and independent.

Referring to (B) of FIG. 7, it is able to know the concept for determining a bit corresponding to identification information $fi_N$ of a current frame. A forward type bit of current frame identification information is determined by a type bit $ft_{N-1}$ of a previous frame, and a backward type bit of current frame identification information is determined by a type bit $ft_N$ of a current frame. In particular, since a forward type bit is placed at a first position and a backward type bit is placed at a second position, identification information of a current frame can be generated. In this case, the first position corresponds to a $(k+1)^{th}$ digit and the second position may correspond to a $k^{th}$ digit. The forward type bit is pushed up by 1 digit from the kit digit and the backward type maintains the kit digit. The case of pushing up one digit means that one digit is shifted left in the binary scale of notation. This can be performed by multiplying the forward type bit by 2. Of course, in case of the N scale of notation, this can be performed by multiplying the forward type bit by N.

Since a current frame type bit is coded with a backward type bit and a forward type is associated with a backward type of a previous frame, it is possible to generate current identification information.

Referring now to FIG. 6, the block number information obtaining unit 231 obtains number information of blocks and the block position information obtaining unit 232 obtains at least one of the aforesaid block start position information and the block end position information according to a frame type represented as current frame identification information $fi_N$. If a frame type is dependent, position information may not be obtained.

The frame identifying unit 240 identifies a type of a current frame using a frame type according to frame identification information $fi_N$. Further, the frame identifying unit 240 is able to identify a position and characteristic of a block using block number information and block position information.

Thus, a frame type identifying apparatus according to an embodiment of the present invention is able to generate identification information indicating a type of a current frame based on the correlation between information of a previous frame and information of a current frame.

2. Block Information

In the above description, frame types, block types and frame type identification and the like are explained. In the following description, block information shall be explained.

2.1 Block number information

Block number information is the information indicating how many blocks corresponding to a specific frame exist. Such a block number can be determined in advance and may not need to be transmitted. On the other hand, since the block number differs per frame, block number information may need to be transmitted for each frame. It is able to encode the block number information as it is. If the number of blocks can be represented as $2^n$ (where n is an integer), it is able to transmit an exponent (n) only. Particularly, if a frame type is dependent (i.e., both a forward type and a backward type are fixed types), it is able to transmit an exponent (n) as the number information of blocks.

2.2 Block Position Identification

In order to identify a position of a block, it is able to recognize a start position of a first block or an end position of a last block within a frame. First of all, in recognizing a start position of a first block, if a forward type of frame types is a fixed type, the start position of the first block may be a frame start position. If the forward type is a variable type, the start position of the first block may not be a frame start position. Hence, it is able to transmit start position information of a block. In this case, the start position information may be an absolute value or a difference value. The absolute value can be a number of a unit corresponding to a start position if a frame is constructed with at least one or more units. The difference value can be a difference between start position information of a nearest frame having start position information among frames existing behind a current frame and start position information of the current frame.

In recognizing an end position of a last block, if a backward type is a fixed type, the end position of the last block may be a frame end position. Meanwhile, when a backward type is a variable type, since the end position may not be a frame end position, it is able to transmit end position information of a block. Likewise, last end position information may have an absolute value or a difference value. In this case, the difference value can be a difference between end position information of a nearest frame having start position information among frames existing behind a current frame and end position information of the current frame.

Meanwhile, in order to identify a position of a block, it is able to recognize a start or end position of an intermediate block instead of a first or last block. Start or end position information of the intermediate block can be an absolute value or a difference value. The absolute value can be a number of a unit corresponding to a start or end position. And, the difference value can be a unit interval between blocks.

Figure 8:
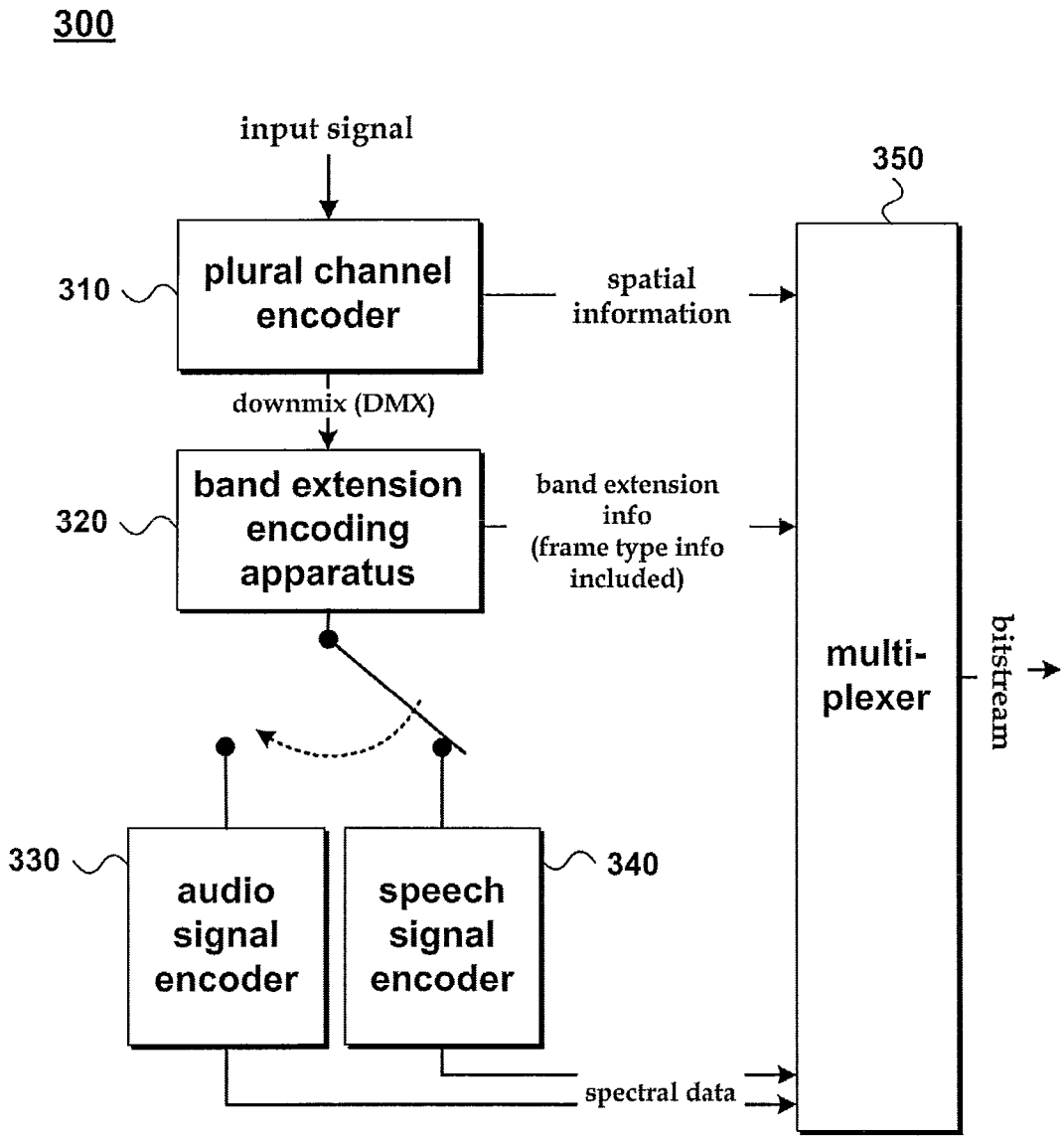
FIG. 8 is a diagram for a first example of an audio signal encoding apparatus to which a frame identification information generating apparatus according to an embodiment of the present invention is applied.

FIG. 8 is a diagram for a first example of an audio signal encoding apparatus to which a frame identification information generating apparatus according to an embodiment of the present invention is applied.

Referring to FIG. 8, an audio signal encoding apparatus 300 can include a plural channel encoder 310, a band extension encoding apparatus 320, an audio signal encoder 330, a speech signal encoder 340 and a multiplexer 350. Meanwhile, a frame information encoding apparatus according to an embodiment of the present invention can be included in the band extension encoding apparatus 320.

The plural channel encoder 310 receives signals having at least two channels (hereinafter named a multi-channel signal) and then generates a mono or stereo downmix signal by downmixing the received multi-channel signal. The plural channel encoder 310 generates spatial information needed to upmix the downmix signal into a multi-channel signal. The spatial information can include channel level difference information, inter-channel correlation information, channel prediction coefficient, downmix gain information and the like.

When the audio signal encoding apparatus 300 receives a mono signal, the plural channel encoder 310 can bypass the mono signal instead of downmixing the mono signal.

The band extension encoding apparatus 320 excludes spectral data of a partial band (e.g., high frequency band) of the downmix signal and is then able to generate band extension information for reconstructing the excluded data. The band extension encoding apparatus 320 can include the respective elements of the frame identification information generating apparatus 100 according to the former embodiment of the present invention described with reference to FIG. 4. Therefore, the band extension information generated by the band extension encoding apparatus 320 can include the frame type information ($ft_N$), the block number information, the block position information and the like, which are explained in the foregoing description. Meanwhile, a decoder is able to reconstruct a downmix of a whole band with a downmix of a partial band and the band extension information only.

If a specific frame or segment of the downmix signal has a large audio characteristic, the audio signal encoder 330 encodes the downmix signal according to an audio coding scheme. In this case, the audio coding scheme may follow AAC (advanced audio coding) standard or HE-AAC (high efficiency advanced audio coding) standard, by which the present invention is non-limited. Meanwhile, the audio signal encoder 330 may correspond to an MDCT (modified discrete transform) encoder.

If a specific frame or segment of the downmix signal has a large speech characteristic, the speech signal encoder 340 encodes the downmix signal according to a speech coding scheme. In this case, the speech coding scheme may follow AMR-WB (adaptive multi-rate wideband) standard, by which the present invention is non-limited. Meanwhile, the speech signal encoder 340 can further use a linear prediction coding (LPC) scheme. If a harmonic signal has high redundancy on a time axis, it can be modeled by linear prediction for predicting a present signal from a past signal. In this case, it is able to raise coding efficiency if the linear prediction coding scheme is adopted. Besides, the speech signal encoder 340 may correspond to a time-domain encoder.

The multiplexer 350 generates an audio bitstream by multiplexing spatial information, band extension information, spectral data and the like.

Figure 9:
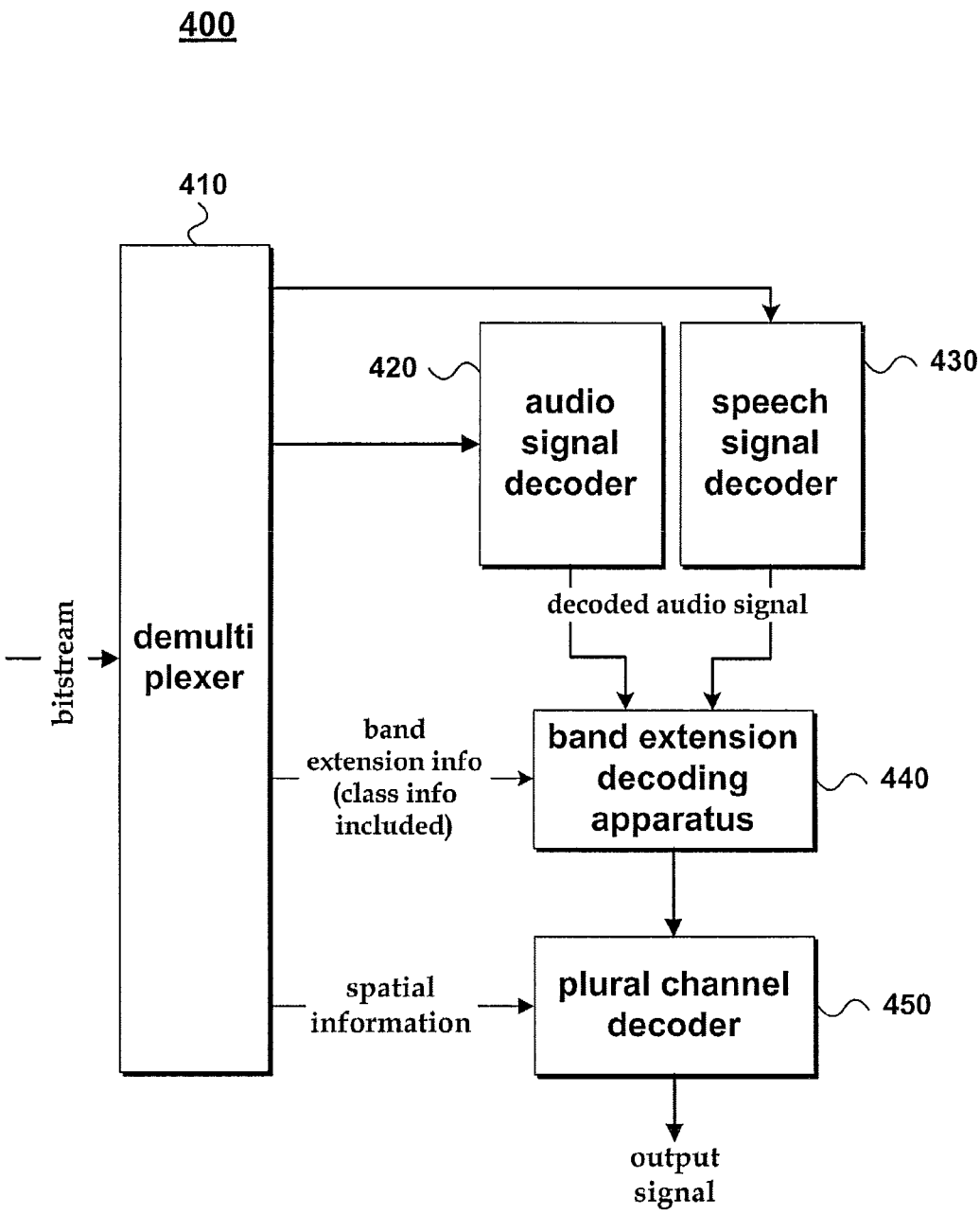
FIG. 9 is a diagram for a first example of an audio signal encoding apparatus to which a frame type identifying apparatus according to an embodiment of the present invention is applied.

FIG. 9 is a diagram for a first example of an audio signal encoding apparatus to which a frame type identifying apparatus according to an embodiment of the present invention is applied.

Referring to FIG. 9, an audio signal decoding apparatus 400 includes a demultiplexer 410, an audio signal decoder 420, a speech signal decoder 430 and plural channel decoder 450.

The demultiplexer 410 extracts spectral data, band extension information, spatial information and the like from an audio signal bitstream.

If the spectral data corresponding to a downmix signal has a large audio characteristic, the audio signal decoder 420 decodes the spectral data by an audio coding scheme. In this case, as mentioned in the above description, the audio coding scheme can follow the AAC standard or the HE-AAC standard.

If the spectral data has a large speech characteristic, the speech signal decoder 430 decodes the downmix signal by a speech coding scheme. As mentioned in the above description, the speech coding scheme can follow the AMR-WB standard, by which the present invention is non-limited.

The band extension decoding apparatus 440 decodes a band extension information bitstream containing frame type information and block information and then generates spectral data of a different band (e.g., high frequency band) from partial or whole part of the spectral data using this information. In this case, in extending a frequency band, it is able to generate a block by grouping into units having similar characteristics. This is as good as generating an envelope region by grouping timeslots (or samples) having the common envelope (or envelope characteristics).

Meanwhile, the band extension decoding apparatus can include all the elements of the frame type identifying apparatus described with reference to FIG. 6. Namely, identification information of a current frame is obtained using frame type information of a previous frame. According to a frame type represented as frame identification information, a different kind of block information is extracted. A block characteristic is obtained using the frame type and the block information. In particular, based on this block characteristic, spectral data of a different band is generated.

Meanwhile, the band extension information bitstream can be the one that is encoded according to the rule represented as Table 2.

TABLE 2

| Syntax | No. of bits | |
|---|---|---|
| sbr_grid(ch) | | |
| { | | |
| frmClass = exFrmClass + bs_frame_class; | 1 | (A) |
| switch (frmClass) { | | |
| case FIXFIX | | (F1) |
| bs_num_env[ch] = 2^tmp; | 2 | (E1N) |
| if (bs_num_env[ch] == 1) | | |
| bs_amp_res = 0; | | |
| bs_freq_res[ch][0]; | 1 | |
| for (env = 1; env < bs_num_env[ch]; env++) | | |
| bs_freq_res[ch][env] = bs_freq_res[ch][0]; | | |
| break; | | |
| case FIXVAR | | (F2) |
| bs_var_bord_1[ch]; | 2 | (E4F) |
| bs_num_env[ch] = bs_num_rel_1[ch] + 1; | 2 | (E2N) |
| for (rel = 0; rel < bs_num_env[ch]−1; rel++) | | |
| bs_rel_bord_1[ch][rel] = 2* tmp + 2; | 2 | (E2F) |
| ptr_bits = ceil (log (bs_num_env[ch] + 1) / log (2)); | | |
| bs_pointer[ch]; | ptr_bits | |
| for (env = 0; env < bs_num_env[ch]; env++) | | |
| bs_freq_res[ch][bs_num_env[ch] − 1 − env]; | 1 | |
| break; | | |
| case VARFIX | | (F3) |
| bs_var_bord_0[ch]; | 2 | (E4S) |
| bs_num_env[ch] = bs_num_rel_0[ch] + 1; | 2 | (E3N) |
| for (rel = 0; rel < bs_num_env[ch]−1; rel++) | | |
| bs_rel_bord_0[ch][rel] = 2* tmp + 2; | 2 | (E2S) |
| ptr_bits = ceil (log (bs_num_env[ch] + 1) / log (2)); | | |
| bs_pointer[ch]; | ptr_bits | |
| for (env = 0; env < bs_num_env[ch]; env++) | | |
| bs_freq_res[ch] [env]; | 1 | |
| break; | | |
| case VARVAR | | (F4) |
| bs_var_bord_0[ch]; | 2 | (E4S) |
| bs_var_bord_1[ch]; | 2 | (E4F) |
| bs_num_rel_0[ch]; | 2 | (E4N) |
| bs_num_rel_1[ch]; | 2 | (E4N) |
| bs_num_env[ch] = bs_num_rel_0[ch] + bs_num_rel_1[ch] + 1; | | |
| for (rel = 0; rel < bs_num_rel_0[ch]; rel++) | | |
| bs_rel_bord_0[ch][rel] = 2* tmp + 2; | 2 | (E4S) |
| for (rel = 0; rel < bs_num_rel_1[ch]; rel++) | | (E4F) |

TABLE 2-continued

| Syntax | No. of bits |
|---|---|
| bs_rel_bord_1[ch][rel] = 2* tmp + 2; | 2 |
| ptr_bits = ceil (log(bs_num_env[ch] + 1) / log (2)); | |
| bs_pointer[ch]; | ptr_bits |
| for (env = 0; env < bs_num_env[ch]; env++) | |
| bs_freq_res[ch][env]; | 1 |
| break; | |
| } | |
| if (bs_num_env[ch] > 1) | |
| bs_num_noise[ch] = 2; | |
| Else | |
| bs_num_noise[ch] = 1; | |
| exFrmClass = bs_frame_class * 2; | (C) |
| } | |

In Table 2, referring to a row (A), it can be observed that type information (bs_frame_class) of a current frame is represented as one bit.

Referring to a row (C) of Table 2, type information ($ft_{N-1}$) of a previous frame is multiplied by 2 (exFrmClass=bs_frame_class*2). Looking into the row (A) of Table 2, it can be observed that frame identification information (frmClass=exFrmClass+bs_frame_class) of the current frame is obtained from adding current frame type information ($ft_N$)(bs_frame_class) to the result (exFrmClass) of multiplying by 2.

Referring to rows (F1) to (F4) of Table 2, types of frame classes are classified. Block number informations of the respective cases exist on rows (E1N) to (E4N), respectively. Start or end position information appears on the row (E2F), (E3S), (E4F) or (E4S). If a decoded audio signal is a downmix, the plural channel decoder 450 generates an output signal of a multi-channel signal (stereo signal included) using spatial information.

A frame type identifying apparatus according to the present invention can be used by being included in various products. These products can be grouped into a stand-alone group and a portable group. In particular, the stand-alone group can include TVs, monitors, settop boxes, etc. The portable group can include PMPs, mobile phones, navigation systems, etc.

Figure 10:
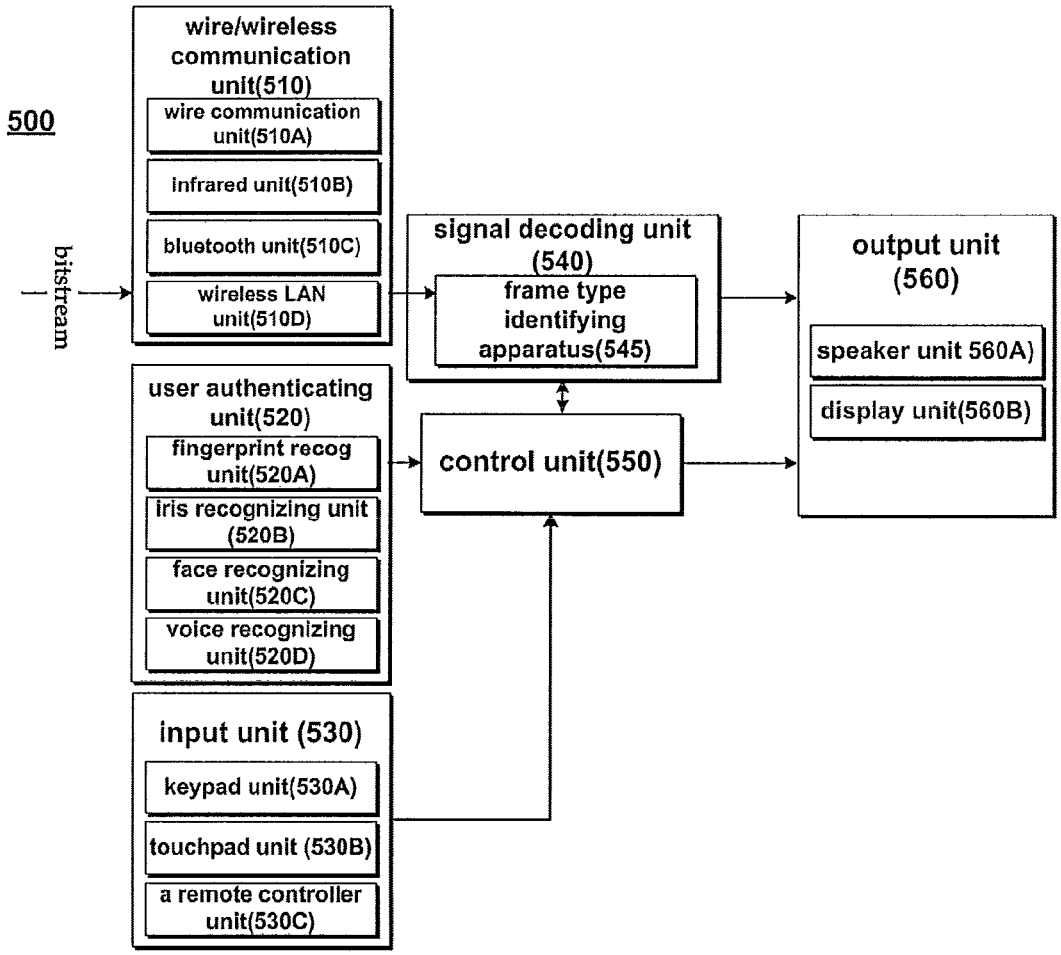
FIG. 10 is a schematic block diagram of a product in which a frame type identifying apparatus according to an embodiment of the present invention is implemented.
Figure 11:
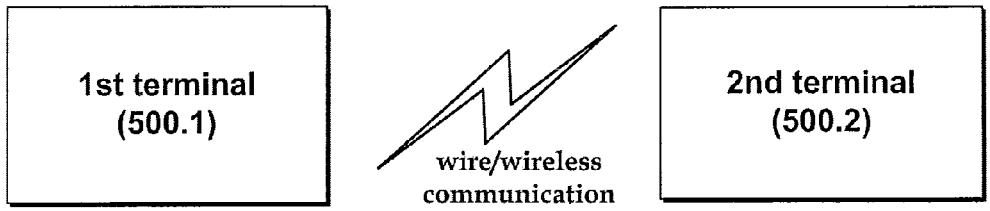
FIG. 11 is a diagram for relations between products, in which a frame type identifying apparatus according to an embodiment of the present invention is implemented.
Figure 11:
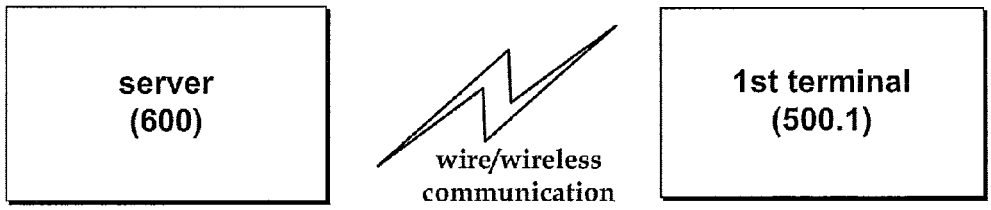

FIG. 10 is a schematic block diagram of a product in which a frame type identifying apparatus according to an embodiment of the present invention is implemented, and FIG. 11 is a diagram for relations between products, in which a frame type identifying apparatus according to an embodiment of the present invention is implemented.

Referring to FIG. 10, a wire/wireless communication unit 510 receives a bitstream via wire/wireless communication system. In particular, the wire/wireless communication unit 510 includes at least one of a wire communication unit 510A, an infrared communication unit 510B, a Bluetooth unit 510C and a wireless LAN communication unit 510D.

A user authenticating unit 520 performs user authentication by receiving a user input. The user authenticating unit 520 is able to include at least one of a fingerprint recognizing unit 520A, an iris recognizing unit 520B, a face recognizing unit 520C and a voice recognizing unit 520D. And, the user authentication can be performed in a manner of receiving fingerprint information, iris information, face contour information or voice information, converting the received information to user information and the determining whether the user information matches previously-registered user data.

An input unit 530 is an input device enabling a user to input various kinds of commands. The input unit 530 is able to include at least one of a keypad unit 530A, a touchpad unit 530B and a remote controller unit 530C, by which the present invention is non-limited.

A signal decoding unit 540 includes a frame type identifying apparatus 545. The frame type identifying apparatus 545 is the apparatus including the frame identification information generating unit of the frame type identifying apparatus described with reference to FIG. 6 and generates frame identification information corresponding to a current frame from frame type information. The signal decoding unit 540 outputs an output signal by decoding a signal using a received bitstream and frame identification information.

A control unit 550 receives input signals from input devices and controls all processes of the signal decoding unit 540 and the output unit 560.

And, the output unit 560 is an element for outputting the output signal generated by the signal decoding unit 540 and the like. Moreover, the output unit 560 is able to include a speaker unit 560A and a display unit 560B. If the output signal is an audio signal, the corresponding signal is outputted to a speaker. If the output signal is a video signal, the corresponding signal is outputted through a display.

FIG. 11 shows relations between a terminal and server corresponding to the product shown in FIG. 10.

Referring to (A) of FIG. 11, it can be observed that first and second terminals 500.1 and 500.2 can bi-directionally communicate with each other by exchanging data or bitstream via wire/wireless communication units.

Referring to (B) of FIG. 11, it can be observed that a server 600 and a first terminal 500.1 can mutually perform wire/wireless communications.

An audio signal processing method according to the present invention can be implemented in a program recorded medium as computer-readable codes. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). Moreover, a bitstream generated by the encoding method is stored in a computer-readable recording medium or can be transmitted via wire/wireless communication network.

Accordingly, the present invention provides the following effects or advantages.

First of all, coding can be performed by eliminating redundancy corresponding to correlation based on the correlation between information of a previous frame and information of a current frame. Therefore, the present invention is able to considerably reduce the number of bits required for coding of the current frame information.

Secondly, information corresponding to a current frame can be generated with a simple combination of a bit received in a current frame and a bit received in a previous frame. Therefore, the present invention is able to maintain complexity in reconstructing information of the current frame.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for processing audio data by an audio data decoder, comprising:

receiving, by the audio data decoder, frame type information of a current frame;

obtaining previously received frame type information of a previous frame by an information extracting unit of the audio data decoder, wherein the frame type information specifies a relationship of positions of the frame and a block included in the frame;

obtaining frame identification information of the current frame based on the frame type information of the current frame and the frame type information of the previous frame by a frame identification information generating unit of the audio data decoder; and identifying the current frame using the frame identification information by a frame identifying unit of the audio data decoder, wherein at least one of the frame type information of the previous frame and the frame type information of the current frame corresponds to a fixed type or a variable type, wherein the fixed type indicates that a start position of the frame coincides with a start position of the block or an end position of the frame coincides with an end position of the block, and wherein the variable type indicates that the start position of the frame fails to coincide with the start position of the block or the end position of the frame fails to coincide with the end position of the block.

2. The method of claim 1, wherein the frame identification information comprises forward type information and backward type information, wherein the forward type information is determined according to the frame type information of the previous frame, and wherein the backward type information is determined according to the frame type information of the current frame.

3. The method of claim 1, further comprising:

if the frame type information of the previous frame is the variable type, determining the start position of the block by the frame identification information generating unit; and if the frame type information of the current frame is the variable type, determining the end position of the block by the frame identification information generating unit.

4. The method of claim 1, wherein, if both of the frame type information of the current frame and the frame type information of the previous frame are fixed types, the number of blocks corresponding to the current frame is $2^n$ (wherein n is an integer).

5. The method of claim 4, wherein the blocks are equal to each other in size.

6. An audio data decoder for processing audio data, comprising:

an information extracting unit configured to receive frame type information of a current frame, the information extracting unit further configured to obtain previously received frame type information of a previous frame, wherein the frame type information specifies a relationship of positions of the frame and a block included in the frame;

a frame identification information generating unit configured to generate frame identification information of the current frame based on the frame type information of the current frame and the frame type information of the previous frame; and a frame identifying unit configured to identify the current frame using the frame identification information, wherein at least one of the frame type information of the current frame and the frame type information of the current frame corresponds to a fixed type or a variable type, wherein the fixed type indicates that a start position of the frame coincides with a start position of the block or an end position of the frame coincides with an end position of the block, and wherein the variable type indicates that the start position of the frame fails to coincide with the start position of the block or the end position of the frame fails to coincide with the end position of the block.

7. The audio data decoder of claim 6, wherein the frame identification information comprises forward type information and backward type information, wherein the forward type information is determined according to the frame type information of the previous frame, and wherein the backward type information is determined according to the frame type information of the current frame.

8. The audio data decoder of claim 6, wherein the frame identification information generating unit is further configured to determine the start position of the block if the frame type information of the previous frame is the variable type, and wherein the frame identification information generating unit is further configured to determine the end position of the block if the frame type information of the current frame is the variable type.

9. The audio data decoder of claim 6, wherein, if both of the frame type information of the current frame and the frame type information of the previous frame are fixed types, the number of blocks corresponding to the current frame is $2^n$ (wherein n is an integer).

10. The audio data decoder of claim 9, wherein the blocks are equal to each other in size.

11. A method for processing audio data by an audio data encoder, comprising:

determining frame identification information of a current frame, the frame identification information comprising a forward type and a backward type by a frame identification information determining unit of the audio data encoder; and generating frame type information of the current frame based on the backward type of the frame identification information by a type information generating unit of the audio data encoder, wherein the frame type information specifies a relationship of positions of the frame and a block included in the frame, wherein the forward type is determined by frame identification information of a previous frame, wherein at least one of frame type information of the previous frame and the frame type information of the current frame corresponds to a fixed type or a variable type, wherein the fixed type indicates that a start position of the frame coincides with a start position of the block or an end position of the frame coincides with an end position of the block, and wherein the variable type indicates that the start position of the frame fails to coincide with the start position of the block or the end position of the frame fails to coincide with the end position of the block.

12. An audio data encoder for processing audio data, comprising:

a frame identification information determining unit configured to determine frame identification information of a current frame, the frame identification information comprising a forward type and a backward type; and a type information generating unit configured to generate frame type information of the current frame based on the backward type of the frame identification information, wherein the frame type information specifies a relationship of positions of the frame and a block included in the frame, wherein the forward type is determined by frame identification information of a previous frame, wherein at least one of frame type information of the previous frame and the frame type information of the current frame corresponds to a fixed type or a variable type, wherein the fixed type indicates that a start position of the frame coincides with a start position of the block or an end position of the frame coincides with an end position of the block, and wherein the variable type indicates that the start position of the frame fails to coincide with the start position of the block or the end position of the frame fails to coincide with the end position of the block.

* * * * *